US005383405A

United States Patent [19]

Everest

[11] Patent Number: 5,383,405

[45] Date of Patent: Jan. 24, 1995

[54] EXPLOSIVE LINES

[76] Inventor: John R. Everest, 8 Torbrook Close, Bexley Kent DA5 1ES, Great Britain

[21] Appl. No.: 50,054

[22] PCT Filed: Nov. 1, 1991

[86] PCT No.: PCT/GB91/01921

§ 371 Date: Aug. 27, 1993

§ 102(e) Date: Aug. 27, 1993

[87] PCT Pub. No.: WO92/08096

PCT Pub. Date: May 14, 1992

[30] Foreign Application Priority Data

Nov. 1, 1990 [GB] United Kingdom ..... 9023730

[51] Int. Cl.[6] ..... F42B 3/093; C06C 5/04

[52] U.S. Cl. ..... 102/275.8; 102/701

[58] Field of Search ..... 102/275.1, 275.8, 275.5, 102/275.6, 701

[56] References Cited

U.S. PATENT DOCUMENTS

| | | | |
|---|---|---|---|
| 2,543,057 | 2/1951 | Porter | 102/307 |
| 3,241,489 | 3/1966 | Andrew et al. | 102/275.8 |
| 3,374,737 | 3/1968 | Pike | 102/275.8 |
| 3,435,763 | 4/1969 | Lavine | 102/701 |
| 3,934,511 | 1/1976 | Cordle et al. | 102/307 |
| 3,939,941 | 2/1976 | Steele | 181/116 |
| 4,407,468 | 10/1983 | Bement et al. | 102/378 |
| 4,753,170 | 6/1988 | Regalbuto et al. | 102/275.8 |
| 5,166,470 | 11/1992 | Stewart | 102/275.5 |
| 5,170,004 | 12/1992 | Garrison | 102/701 |

FOREIGN PATENT DOCUMENTS

| | | |
|---|---|---|
| 0052521 | 11/1981 | European Pat. Off. . |
| 994750 | 11/1951 | France . |
| 1180037 | 6/1959 | France . |
| 2072801 | 9/1971 | France . |
| 1473031 | 5/1975 | France . |
| 2214618 | 9/1989 | United Kingdom . |
| PCT/GB86/-00292 | 5/1986 | WIPO . |

*Primary Examiner*—David Brown
*Attorney, Agent, or Firm*—Kinney & Lange

[57] ABSTRACT

An explosive line including a pliable impervious outer casing and a filling of explosive material within the casing. An outer surface of the casing has a plurality of generally flat faces which are spaced about the explosive line so as to provide an outer surface of generally polygonal section.

8 Claims, 2 Drawing Sheets

EXPLOSIVE LINES

BACKGROUND OF THE INVENTION

This invention relates to explosive lines sometimes known as detonation cord.

A standard form of explosive line is a small diameter water impervious pliable plastic casing or tube containing an explosive charge. Such explosive lines are commonly and extensively used in demolition work, for example, and are also utilised in some forms of minefield breaching systems in which they are adapted to be carried by means of a projectile across a minefield, whereafter they are detonated to breach a pathway through the minefield.

Commonly, such explosive lines are packed ready for use within a container of circular plan view, the line being carefully wound within the container so that it can, after removal of the lid of the container, be easily and smoothly withdrawn therefrom to any required length.

It is an object of the present invention to provide an improved explosive line.

SUMMARY OF THE INVENTION

In accordance with the invention there is provided an explosive line comprising a pliable impervious outer casing and a filling of explosive material, the casing being such that the outer surface thereof has a plurality of generally flat faces. The generally flat faces may be spaced about the explosive line so as to provide an outer surface of generally polygonal section such as triangular, rectangular or square, for example.

The casing is preferably of an appropriate plastics material, or a woven or knitted natural or artificial fibre for example.

To ensure that the explosive line encloses maximum mass and volume of explosive, the inner surface preferably generally follows the outer surface in its configuration.

Previously available explosive line has been of a generally circular form in cross-section, which has meant that when coiled and layered within a container therefor ready for use, of necessity a multiplicity of unused spaces are present between and around the coiled explosive line. By means of the invention, it is possible to ensure, by arranging to abut appropriate generally flat faces of the outer surface of the explosive line against one another, that the line can fit more closely within the container, with few, if any, spaces between successive coils and layers. The result of this is either that within a given size container, a greater volume of line can be accommodated, or (and perhaps more usefully) the same volume of explosive line can be fitted within a container of smaller dimensions and therefore lesser weight. This reduction in weight is clearly advantageous in general terms, but is particularly so in relation to the use of an explosive line in minefield breaching systems, since it reduces the substantial weight which an infantry soldier carrying such a minefield breaching system has to carry.

It is to be understood that the expression "generally flat faces" in relation to the explosive line and in the context of a pliable casing includes faces of some limited curvature, subject to satisfying the intent that reduction of packing space is provided by abutting generally flat faces against one another.

As has been specified hereinabove the configuration of the explosive line in accordance with the invention can be a three or four sided figure, but it is to be noted that the configuration can be such as to have even a greater number of generally flat sides, such as from five to ten flat sides. By providing such a configuration, in addition to the possibility of accommodation space reduction hereinbefore mentioned, study of the literature shows that with appropriate design a maintained or even increased explosive effect can be produced at the same time as the geometric size and/or weight of the explosive line has been reduced. The practical effect of this is that not only can the line be used for minefield breaching for example as hereinabove described, but also can be used for the breaching of obstacles, such as barbed wire, because of the possibility of increased explosive effect.

The plurality of generally flat sides may include at least some which are re-entrant so as to provide what can best be described as a "concave" portion to the explosive line. This provides the explosive line on at least some sides with a hollow shaped charge structure. If such re-entrant sides are spaced all around the explosive line, in practice effectively a hollow charge structure will always be facing a target, in the sense of mine clearance or obstacle breaking, of the explosive charge. Such hollow shaped charges are known to provide heightened explosive effects, by what is known as the "Munroe effect" or the "cavity effect". By increasing the explosive effects still further, such re-entrant sides, most importantly for the present invention, enable the reduction of the total weight of the explosive line per unit volume of line considerably.

The re-entrant walls of the explosive contained within the line may be lined with a coating of a non-explosive material such as paper or a metal such as copper, aluminium, tungsten or any other appropriate metal. Such a lining acts as an energy carrier and concentrator. The metal or similar material may be added as a foil coating to the explosive before applying the pliable impervious outer casing of the explosive line of the invention.

The use of the just mentioned geometrical configuration of the explosive line can significantly reduce the size and weight of a man portable minefield and/or obstacle breaching kit.

In one preferred embodiment of the invention, the explosive line may be of star configuration with, for example, five points to the star thereby having ten re-entrant generally flat surfaces. Such star shaped line allows very tight packing density in a portable container compared with the circular section configuration of explosive line previously used, which is a most useful practical result.

The charge may be provided with a hollow portion along its length, which may be along the centre of the charge or offset to one side. Such an arrangement can reduce the weight per unit volume of the line without reducing the explosive effectiveness.

BRIEF DESCRIPTION OF THE DRAWINGS

In order that the invention may be more readily understood, two embodiments thereof will now be described by way of example with reference to the accompanying drawings in which.

DETAILED DESCRIPTION OF THE PREFERRED EMBODIMENTS

Figure 1:
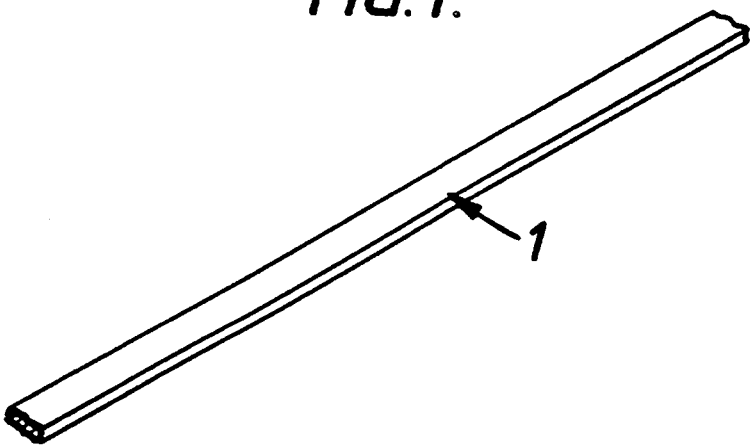
FIG. 1 is an isometric view of a rectangular shaped length of explosive line in accordance with the invention.
Figure 2:
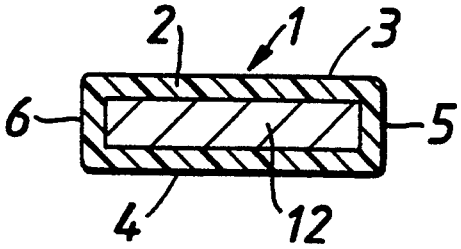
FIG. 2 is a cross-section on an enlarged scale of the explosive line of FIG. 1.

Referring now to FIGS. 1 and 2 it will be seen that the explosive line 1 comprises a flexible and pliable casing 2 of appropriate impervious plastics material of rectangular configuration both on its outer and inner surfaces, and having two opposed larger flat sides 3, 4, and two opposed smaller flat sides 5, 6.

Figure 3:
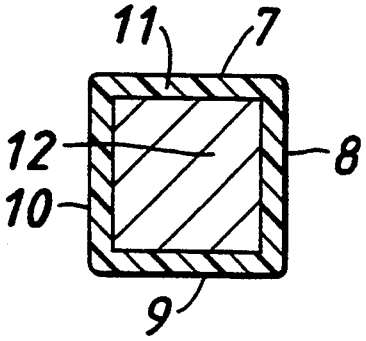
FIG. 3 is a cross-section of a square section explosive line in accordance with the invention.

The arrangement of FIG. 3 is similar except that in this case all four sides 7, 8, 9, 10 of the casing 11 are of equal dimension.

In each example, the explosive line is provided with a continuous length of explosive material 12.

The explosive lines of the embodiments of FIGS. 1 and 2 can be fitted within an open-topped container of circular plan very tightly by appropriate coiling and layering leaving practically no spaces between coils and layers of an explosive line wound therein, so that a given quantity of explosive line can be fitted into a smaller and hence lighter container than if the explosive line were of circular section.

Figure 4:
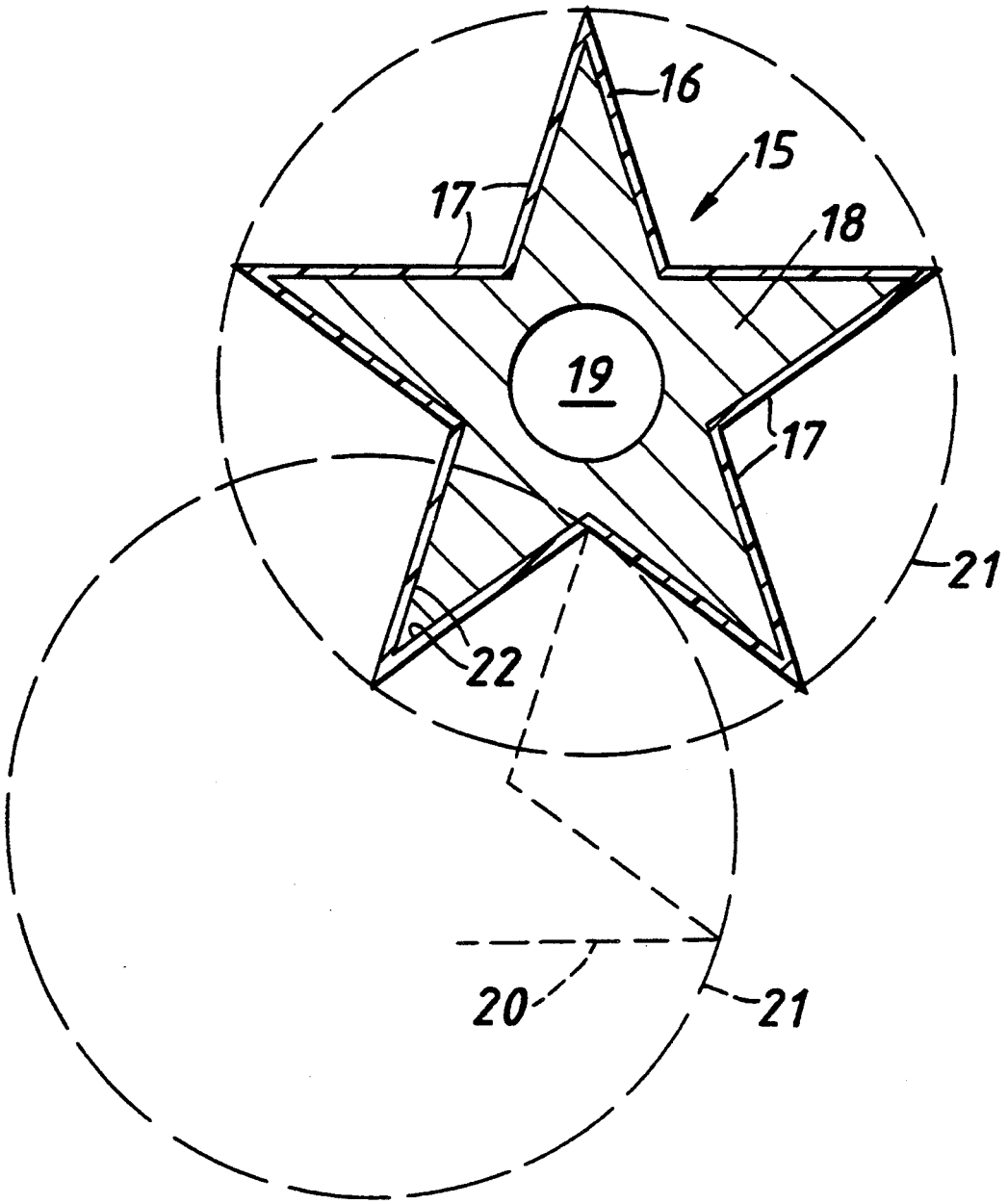
FIG. 4 is a cross-section of a five pointed star section explosive line in accordance with the invention.

Reference to FIG. 4 illustrates another embodiment of the invention in which the explosive line 15 comprises an extrusion of an impervious plastics casing 16 having ten re-entrant flat outer surfaces 17 and corresponding inner surfaces 22 forming an explosive line of five pointed star configuration within which is disposed an appropriate explosive charge 18. As can be seen the charge is provided with a hollow 19 along its length about its centre.

As previously mentioned the use of the hollow shaped charge provided by the re-entrant sides produces, by the Munroe effect, an increased effectiveness in operation of the explosive charge. At the same time, and most significantly, as can be seen by the part of an adjacent explosive line 20 of five pointed star shaped indicated in dotted lines, it is possible for the star shaped line to be very closely packed compared to a circular section explosive line 21 having the same maximum diameter as the star shaped line, so that packing volume in a portable container is most substantially reduced, whilst at the same time the weight per unit length of the explosive line is significantly reduced, both of which effects are of extremely considerable benefit to the operator carrying the container with a normal operational length of explosive line.

It is to be understood that the foregoing is merely exemplary of explosive lines in accordance with the invention and that modifications can readily be made thereto without departing from the true scope of the invention.

What is claimed is:

1. An explosive line comprising a pliable impervious outer casing and a filling of explosive material within the casing, the casing being such that the outer surface thereof has a plurality of generally flat faces, and the explosive material within the casing including an internal hollow shaping along its length, said hollow shaping being surrounded entirely by said explosive material.

2. An explosive line as claimed in claim 1 wherein the generally flat faces are spaced about the explosive line so as to provide an outer surface of generally polygonal section.

3. An explosive line as claimed in claim 1 wherein the casing is formed of a plastics material.

4. An explosive line as claimed in claim 1 wherein the inner surface of the outer casing generally follows the outer surface in its configuration.

5. An explosive line as claimed in claim 1 wherein the configuration of the outer surface has ten generally flat sides.

6. An explosive line as claimed in claim 1 wherein the plurality of generally flat sides includes at least some which are re-entrant so as to provide, in effect, a concave portion to the line.

7. An explosive line as claimed in claim 6 wherein the re-entrant sides are spaced around the line.

8. An explosive line as claimed in claim 7 of star configuration.

* * * * *